US005744914A

United States Patent [19]

Konishi

[11] Patent Number: 5,744,914

[45] Date of Patent: Apr. 28, 1998

[54] FLAT DISPLAY DEVICE AND METHOD OF DRIVING SAME

[75] Inventor: Morikazu Konishi, Kanagawa, Japan

[73] Assignee: Sony Corporation, Japan

[21] Appl. No.: 637,370

[22] Filed: Apr. 25, 1996

[30] Foreign Application Priority Data

May 2, 1995 [JP] Japan ..... 7-108561

[51] Int. Cl.[6] ..... G09G 3/10

[52] U.S. Cl. ..... 315/169.1; 315/169.3; 345/74; 345/208

[58] Field of Search ..... 315/169.1, 169.4, 315/169.3; 345/74, 76, 211, 212, 208

[56] References Cited

U.S. PATENT DOCUMENTS 5,572,231 11/1996 Kobori ..... 345/74

*Primary Examiner*—Robert Pascal

*Assistant Examiner*—Arnold Kinkead

*Attorney, Agent, or Firm*—Ronald P. Kananen

[57] ABSTRACT

A flat display device having microcathodes where the selected pixel is turned ON and OFF by a high frequency which can reduce the amplitude between ON voltage and OFF voltage and reduce the power consumption and a driving method thereof. The device has microcathodes arranged in the form of a matrix; gate electrodes controlled so that electrons are selectively discharged from the microcathodes; emitter electrodes for supplying a negative voltage to the gate electrodes of one or more selected microcathodes; a DC voltage supplying unit for supplying a DC bias voltage giving an emission current of a predetermined value or less between the emitter electrode and gate electrode irrespective of selection and non-selection; and a selective voltage supplying unit which supplies a voltage to an extent where the electrons are emitted from the microcathodes between the emitter electrode and the gate electrode of the selected microcathodes while being superimposed on the DC bias voltage.

3 Claims, 6 Drawing Sheets

FLAT DISPLAY DEVICE AND METHOD OF DRIVING SAME

BACKGROUND OF THE INVENTION

1. Field of the Invention

The present invention relates to a flat display device and a method of driving the same, more particularly to a flat display device having field emission type microcathodes, and to a method of driving the same.

2. Description of the Related Art

Flat display devices have come under attention as the technology to take the place of cathode ray tubes in displays of small-size computers, word processors, wall televisions, etc. in recent years. Among them, a display having field emission type microcathodes has the advantages of a high luminance and high speed response in comparison with the liquid crystal displays now the mainstream of flat displays and may become the main flat display technology.

In such field emission type microcathodes, where, $V_e$ is an electrode beam extraction voltage, $V_e/2$ is supplied to the emitter electrode of the row address to which a selected pixel belongs, while $-V_e/2$ is supplied to the gate electrode of the column address to which the selected pixel belongs. The voltage $V_e$ in total is generated between the emitter electrode and gate electrode of the selected pixel. Electrons are selectively emitted from the microcathodes connected to the emitter electrode (refer to Japanese Unexamined Patent Publication (Kokai) No. 61-221783). 0V is supplied to the gate electrodes to which the nonselected pixels belong and the emitter electrodes to which the non-selected pixels belong.

For example where the extraction voltage $V_e$ of the electron beam is 100V, a voltage of −50V is supplied to the emitter electrode of the row address to which the selected pixel belongs and a voltage of +50V is supplied to the gate electrode of the column address to which the selected pixel belongs. 0V is supplied to the gate electrodes to which the nonselected pixels belong and the emitter electrodes to which the non-selected pixels belong.

In such a driving method as a related art, however, when the selected pixel is turned on or off at a high cycle, the amplitude between ON voltage and OFF voltage is large, which becomes a cause preventing the reduction of the power consumption of the field emission type microcathodes.

SUMMARY OF THE INVENTION

The present invention was made in consideration of such an actual circumstance and has as an object thereof to provide a flat display device which can reduce the amplitude between ON voltage and OFF voltage when turning a selected pixel ON or OFF at a high frequency and which reduces the power consumption of the flat display device having microcathodes, and a method of driving the same.

To achieve the above object, according to one aspect of the present invention, there is provided a flat display device having microcathodes arranged in the form of a matrix; gate electrodes controlled so that electrons are selectively discharged from the microcathodes; emitter electrodes for supplying a negative voltage to the gate electrodes of one or more selected microcathodes; a DC voltage supplying means for supplying a DC bias voltage giving an emission current of a predetermined value or less between the emitter electrode and gate electrode irrespective of selection and non-selection; and a selective voltage supplying means for supplying a voltage of an extent where electrons are emitted from the microcathodes between the emitter electrode and the gate electrode of the selected microcathodes while being superimposed on the DC bias voltage.

Preferably, the DC bias voltage giving the emission current of the predetermined value or less is supplied between the emitter electrodes and the gate electrodes by the DC voltage supplying means irrespective of selection and non-selection so that the emission current of the selected microcathodes becomes 10 times or more of the emission current of the non-selected microcathodes.

It is also possible if the DC bias voltage giving the emission current of the predetermined value or less is supplied between the emitter electrodes and the gate electrodes irrespective of selection and nonselection with respect to only the microcathodes existing in a predetermined region of the entire screen plane in the display device.

Where the voltage supplied between the emitter electrode and the gate electrode of the selected microcathodes is defined as V, the voltage supplied to the gate electrodes of the microcathodes irrespective of selection and non-selection by the DC bias voltage supplying means is defined as $\alpha$, the voltage supplied to the emitter electrodes of the microcathodes is defined as $\beta$, the voltage supplied to the selected gate electrode by the selective voltage supplying means while being superimposed on the voltage supplied by the DC bias voltage supplying means is defined as $\Delta\alpha$, and the voltage supplied to the selected emitter electrode is defined as $\Delta\beta$, preferably the sum of the absolute value of $\alpha$, the absolute value of $\beta$, the absolute value of $\Delta\alpha$, and the absolute value of $\Delta\beta$ is V, the sum of the absolute value of $\alpha$, the absolute value of $\beta$, and the absolute value of $\Delta\alpha$ is v/2 or more, and the sum of the absolute value of $\alpha$, the absolute value of $\beta$, and the absolute value of $\Delta\beta$ is V/2 or more.

According to a second aspect of the present invention, there is provided a method of driving a flat display device having microcathodes arranged in the form of a matrix, gate electrodes controlled so that electrons are selectively emitted from the microcathodes, and emitter electrodes for supplying a negative voltage to the gate electrodes of one or more selected microcathodes, wherein a DC bias voltage of an electron beam extraction voltage or less is supplied between the emitter electrodes and the gate electrodes irrespective of selection and non-selection and the emitter electrodes and gate electrodes are scanned so as to supply a voltage to an extent where the electrons are emitted from the microcathodes between the emitter electrode and the gate electrode of the selected microcathodes while being superimposed on the DC bias voltage.

In the flat display device and method of driving thereof according to the present invention, the DC voltage supplying means supplies the DC bias voltage which gives an emission current of a predetermined value or less between the emitter electrodes and the gate electrodes irrespective of selection and nonselection. Then, a voltage of an extent causing electrons to be emitted from the microcathodes is supplied between the emitter electrode and the gate electrode of the microcathodes corresponding to the selected pixel while superimposed on the DC bias voltage.

Namely, between the emitter electrode and the gate electrode of the microcathodes corresponding to the selected pixel, an extremely fine signal voltage ($\Delta\alpha$ for the gate electrode and $\Delta\beta$ for the emitter electrode) is merely superimposed on the DC bias voltage ($\alpha$ for the gate electrode and $\beta$ for the emitter electrode), while between the gate electrode and emitter electrode of the microcathodes corresponding to the selected pixel, a voltage of the electron beam extraction voltage or more is supplied. As a result, sufficient electrons are emitted from the selected microcathodes, and a sufficient emission current can be obtained.

In the present invention, the DC bias voltage giving an emission current of a predetermined value or less is also supplied between the gate electrodes and emitter electrodes of the microcathodes corresponding to the non-selected pixels. However, if the emission current of the non-selected microcathodes is 1/10 or less of the emission current of the selected microcathodes, a proper luminance and contrast can be obtained.

In the present invention, as mentioned above, the selection of the pixel is carried out by superimposition of a very fine signal voltage with respect to the DC bias voltage, therefore the amplitude of the on voltage/off voltage can be made small and a reduction of the power consumption of the flat display device having microcathodes can be achieved. Also, with a power consumption the same as that of a conventional device, it becomes possible to set the driving frequency high.

BRIEF DESCRIPTION OF THE DRAWINGS

The present invention will become more apparent by the following detailed explanation of the preferred embodiments with reference to the accompanying drawings, in which.

DESCRIPTION OF THE PREFERRED EMBODIMENTS

Below, a detailed explanation will be made of the flat display device according to one embodiment of the present invention with reference to the drawings.

First embodiment

First, an explanation will be made of the embodiment shown in FIG. 1.

Figure 1:
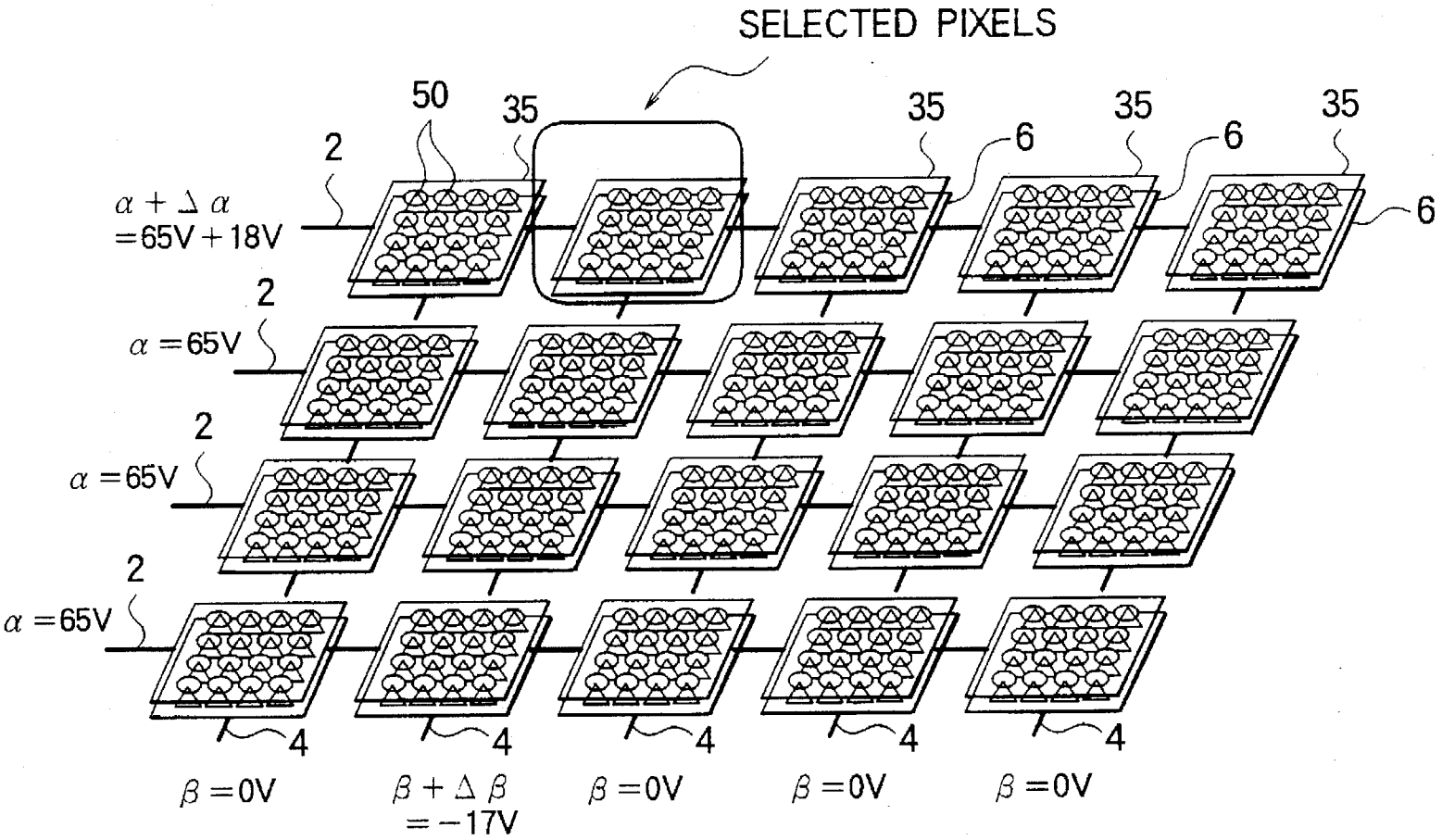
FIG. 1 is a schematic perspective view of a method of driving a flat display device according to an embodiment of the present invention.

FIG. 1 is a schematic perspective view of a method of driving a flat display device according to an embodiment of the present invention, As shown in FIG. 1, in the present embodiment, a plurality of microcathodes 50, for example, 4×4=16, are defined as one pixel unit and are arranged in the form of a matrix. To the group of microcathodes 50 of one pixel unit, an emitter electrode 6 is commonly connected. In an upper portion of the group of microcathodes 50 of one pixel unit, a gate electrode 35 in which grid holes are formed corresponding to the microcathodes 50 is arranged. The surroundings of the microcathodes 50 are held at a high vacuum.

The gate electrodes 35 of the groups of microcathodes 50 of the pixel units have row scanning lines 2 connected to them. The emitter electrodes 6 have column scanning lines 4 connected to them. The row scanning lines 2 have a row driving circuit, not shown, connected to them, while the column scanning lines 4 have a column driving circuit, not shown, connected to them.

Although the illustration is omitted, fluorescent surfaces are formed on the gate electrodes 35 which emit light by irradiation of electron beams selectively emitted from the microcathodes 50 to display a desired image.

Figure 2:
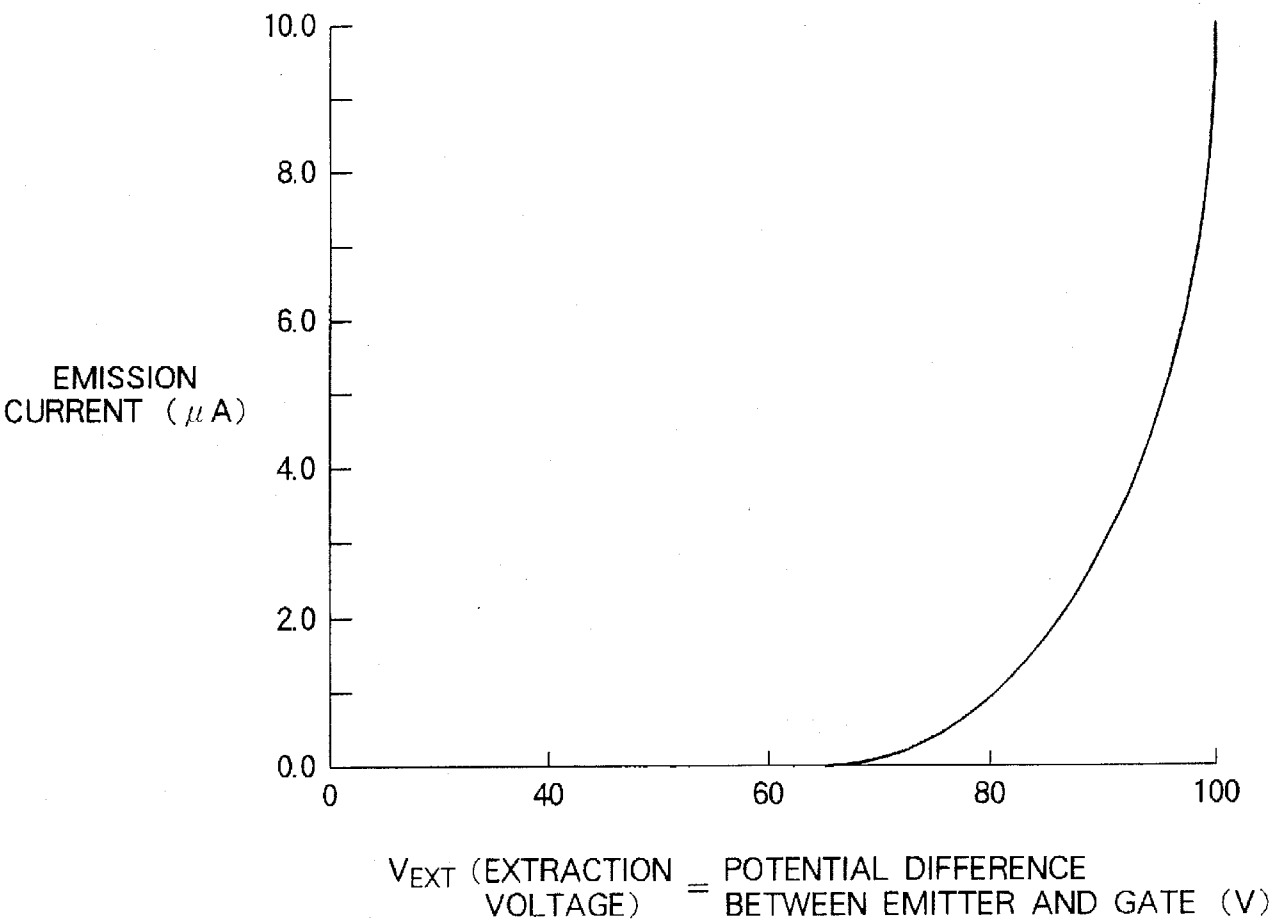
FIG. 2 is a graph of the relationship between a extraction voltage of microcathodes and an emission current.

FIG. 2 is a graph showing the relationship between the extraction voltage of microcathodes and the emission current.

The microcathodes 50 according to the present embodiment emit electrons and as shown in FIG. 2, the emission current becomes 10 μA, when the potential difference between the emitter electrodes 6 and the gate electrodes 35 (extraction voltage) is 100V, that is, when the potential of the emitter electrodes 6 is lower than that of the gate electrodes 35 by 100V. As shown in FIG. 2, when the extraction voltage is 70V or less, almost no electrons are emitted from the microcathodes 50, and no emission current flows.

In the present embodiment, irrespective of the selected pixel and non-selected pixels, a voltage of $\alpha$=65V is supplied to the gate electrodes 35 through the row scanning lines 2, and a voltage of $\beta$=0V is applied to the emitter electrodes 6 through the column scanning lines 4. These voltages are supplied from the row driving circuit and the column driving circuit. Namely, irrespective of the selected pixel and the non-selected pixels, a DC bias voltage is applied between the emitter electrodes and the gate electrodes.

In the present embodiment, to select a pixel, a voltage of $\Delta\alpha$=18V is supplied to only the gate electrode 35 to which the microcathodes 50 corresponding to the pixel to be selected belong via the row scanning line 2 while being superimposed on the voltage $\alpha$ and, at the same time, a voltage of $\Delta\beta$=−17V is supplied to only the emitter electrode 6 to which the microcathodes 50 corresponding to the pixel to be selected belong via the column scanning line 4 while being superimposed on the voltage $\beta$.

In the present embodiment, the sum of the absolute value of $\alpha$, the absolute value of $\beta$, the absolute value of $\Delta\alpha$, and the absolute value of $\Delta\beta$ is an extraction voltage $V_{ext}$=100V. Also, the sum of the absolute value of $\alpha$, the absolute value of $\beta$, and the absolute value of $\Delta\alpha$ is 83V and $V_{ext}/2$ or more and the sum of the absolute value of $\alpha$, the absolute value of $\beta$, and the absolute value of $\Delta\beta$ is 82V and $V_{ext}/2$ or more.

As a result, in the group of microcathodes 50 corresponding to the selected pixel, a voltage of $\alpha+\Delta\alpha-(\beta+\Delta\beta)$=100V, which is the extraction voltage, is supplied between the gate electrode 35 and the emitter electrode 6. Also, in the groups of nonselected microcathodes 50, either of the voltage of $\alpha-\beta$=65V, $\alpha+\Delta\alpha-\beta$=83V, or $\alpha-(\beta+\Delta\beta)$=82V is supplied between the gate electrodes 35 and the emitter electrodes 6.

When the voltage between an emitter electrode and a gate electrode is 100V, the emission current from the microcathodes is about 10 μA as shown in FIG. 2. When the voltage between the emitter electrode and the gate electrode is 83V, as shown in FIG. 2, the emission current is about 1 μA, which is about 1/10 of 10 μA. Accordingly, in the present embodiment, in parts of the groups of microcathodes 50 of the nonselected pixels, the emission current flows. However, the current is about 1/10 or less of the emission current of the microcathodes of the selected pixel, so proper luminance and contrast can be obtained in the flat display device.

The voltage $\Delta\alpha$ supplied to the row scanning line 2 to select a pixel is supplied superimposed on the voltage $\alpha$ so that the row driving circuit scans the rows. The voltage $\Delta\beta$ supplied to the column scanning line 4 to select the pixel is supplied superimposed on the voltage $\beta$ so that the column driving circuit scans the columns.

In the present embodiment, between the emitter electrode 6 and the gate electrode 35 of the microcathodes 50 corresponding to the selected pixel, an extremely fine signal voltage ($\Delta\alpha$ for the gate electrode and $\Delta\beta$ for the emitter electrode) is superimposed on the DC bias voltage ($\alpha$ for the gate electrode and $\beta$ for the emitter electrode), while between the gate electrode and emitter electrode of the microcathodes 50 corresponding to the selected pixel, a voltage of the electron beam extraction voltage or more is applied. As a result, sufficient electrons are emitted from the selected group of microcathodes 50 and a sufficient emission current can be obtained.

Also, in the present embodiment, the selection of a pixel is carried out by superimposing a very fine signal voltage on the DC bias voltage, therefore the amplitude between ON voltage and OFF voltage can be made small and a reduction of the power consumption of the flat display device having the microcathodes 50 can be achieved. Also, with a power consumption the same as that of the conventional device, it becomes possible to set the driving frequency high.

An explanation will be made below of an example of the method of production of the microcathodes 50 according to the present embodiment.

FIGS. 5A to 5D are schematic views of the production steps of microcathodes according to an embodiment of the present invention.

Figure 5A:
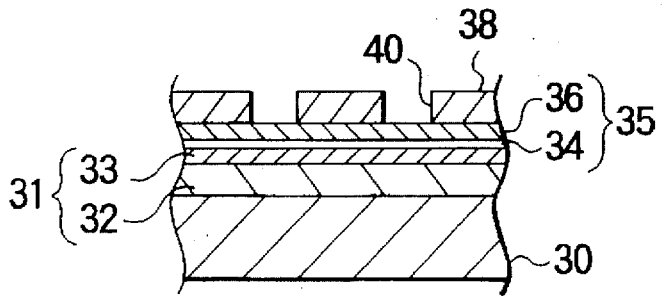
FIGS. 5A to 5D are schematic views of the production steps of microcathodes according to one embodiment of the present invention.

In the present embodiment, first, as shown in FIG. 5A, an insulation layer 31 and a gate electrode 35 are sequentially formed on a semiconductor substrate 30. As the semiconductor substrate 30, for example, a single crystal silicon substrate is used.

In the present embodiment, the insulation layer 31 is formed by a main insulation layer 32 and a hydrogen-containing layer 33. The main insulation layer 32 is constituted by silicon oxide formed by for example a chemical vapor deposition process, while the hydrogen-containing layer 33 is constituted by hydrogen-containing silicon oxide formed by plasma chemical vapor deposition carried out subsequent to the chemical vapor deposition for forming the main insulation layer 32. The main insulation layer 32 constituted by the silicon oxide film is formed by chemical vapor deposition under for example the following conditions. As a starting material gases for the chemical vapor deposition, $SiH_4$ and $O_2$ are used. The conditions are a flow rate ratio of $SiH_4/O_2$ of 300/300 SCCM, an atmospheric pressure of 300 Pa, a substrate temperature of 400° C., and a film-forming time of 4 minutes. The thickness of the main insulation layer 32 is for example 0.8 μm.

Subsequently, the hydrogen-containing layer 33 constituted by the hydrogen-containing silicon oxide film formed by the plasma chemical vapor deposition is formed by the plasma chemical vapor deposition under for example the following conditions. As the starting material gases for the plasma chemical vapor deposition, $SiH_4$ and $O_2$ are used. The conditions are a flow rate ratio of $SiH_4/O_2$ of 400/300 SCCM, an atmospheric pressure of 300 Pa, a substrate temperature of 350° C., and a film-forming time of 1 minute. The thickness of this hydrogen-containing layer 33 is for example 0.2 μm.

The gate electrode 35 is not particularly restricted, but in the present embodiment, a "polycide film" comprised of a laminate of a polycrystalline silicon film 34 of an $n^+$ conductivity type and a tungsten silicide ($WSi_x$) film 36 is used. This gate electrode 35 acts as the grid of for example microcathodes. Note that, the step of forming the emitter electrodes on the surface of the semiconductor substrate 30 is omitted.

The film thickness of the polycrystalline silicon film 34 is for example 50 nm. The thickness of the tungsten silicide film 36 is for example 150 to 300 nm. The polycrystalline silicon film 34 and the tungsten silicide film 36 are formed by for example chemical vapor deposition. The polycrystalline silicon film 34 is formed under for example the following conditions. As the starting material gases for the chemical vapor deposition, $SiH_4$ and $PH_3$ are used. The conditions are an $SiH_4/PH_3$ flow rate ratio of 500/0.3 SCCM, an atmospheric pressure of 100 Pa, and a substrate temperature of 500° C. The tungsten silicide film 36 is formed under for example the following conditions. As the starting material gases for the chemical vapor deposition, $WF_6$, $SiH_4$, and He are used. The conditions are an $WF_6/SiH_4/He$ flow rate ratio of 3/300/500 SCCM, atmospheric pressure of 70 Pa, and a substrate temperature of 360° C.

Next, a resist film 38 is formed on this tungsten silicide film 36, and openings 40 are formed in this resist film 38 by a photolithographic process in a predetermined pattern corresponding to the cathode holes. The inner diameter of these openings 40 corresponds to the inner diameter of the cathode holes and is for example about 0.8 μm. The resist film 38 is not particularly restricted, but for example a G-line (436 nm) resist of the Novolak system can be used.

Next, the semiconductor substrate 30 on which this resist film 38 is formed is disposed in for example a general plasma etching equipment where etching is carried out by using the resist film 38 as a mask. The plasma etching equipment is not particularly restricted, but for example a microwave electron cyclotron resonance plasma (ECR) etching equipment, an induction coil type plasma (ICP) etching equipment, a helicon wave plasma etching equipment, a trans-coupled plasma (TCP) etching equipment, etc. can be exemplified.

Figure 5B:
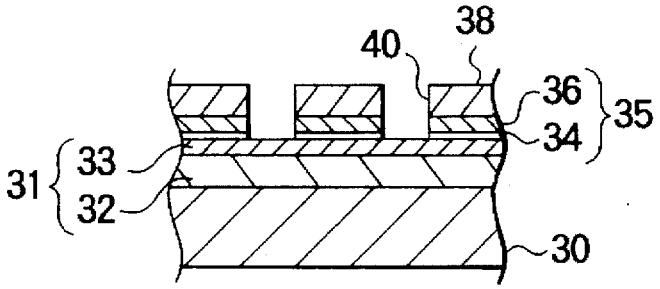
Figure 5C:
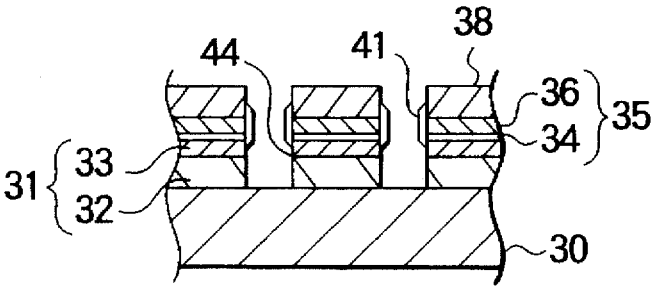

First, for example, the ECR etching equipment is used to continuously etch the tungsten silicide film 36 and the polycrystalline silicon film 34 under the following conditions as shown in FIG. 5B.

As the etching gas, a gas mixture of $Cl_2$ and $O_2$ is used. The flow rate ratio of $Cl_2/O_2$ is set as 75/5 SCCM. The atmospheric pressure is 1.0 Pa. Also, the microwave power is 900 W, the radio frequency (RF) power is 50 W (2 MHz), and the substrate temperature is 20° C. (20 degree).

Subsequently, the insulation layer 31 is etched. At the time of the etching, for example, the ECR type plasma etching equipment is used. The etching conditions thereof are shown next.

Gas: $CHF_3/CH_2F_2$=45/5 SCCM
Pressure: 0.27 Pa
μ-wave output: 1200 W
RF bias: 225 W (800 kHz)
Substrate temperature: 20° C.

In the related art, in such continuous etching of a multilayer film, the resist film 38 retracts due to excessive over-etching under high energy conditions, the side walls of the openings 40 thereof are shaved, the tungsten silicide film 36 positioned at a lower layer thereof is partially etched, and a tapered shape is formed. This can be considered to be due to the fact that, since the gate electrode 35 and the insulation layer 32 are subjected to etching by the same resist film 38, the time during which the resist film 38 is exposed to the plasma etching becomes longer in comparison with that in the conventional contact hole-forming etching technology. In the present embodiment, however, the hydrogen-containing layer 33 is provided in the insulation layer 31, so the hydrogen generated when the hydrogen-containing layer 33 with the rich hydrogen (several tens of wt %) is being etched increases the C/F ratio in the vicinity of the holes 44 and forms a deposition atmosphere, whereby a fluorocarbon-based deposit as seen at the usual $SiO_2$ etching becomes a side wall protection film 41 and prevents the retraction of the photoresist 38. Accordingly, no over-etching up to even the side walls of the openings of the gate electrode 35 occurs. As a result, a shoulder drop of the tungsten silicide film 38 etc. can be prevented, and cathode holes 44 having a good anisotropic shape can be formed.

Figure 5D:
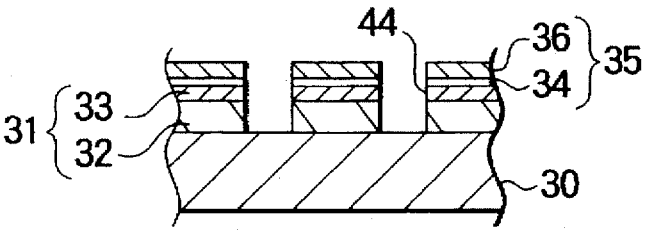

Next, as shown in FIG. 5D, the resist film 38 is removed by resist ashing. The resist ashing is carried out by using $O_2$ of 500 SCCM and under conditions of an atmospheric pressure of 3.0 Pa, substrate temperature of 200° C., and a radio frequency (RF) power of 300 W. At the same time or in the subsequent step of the removal of this resist film 38, the side wall protection film 41 is also removed.

Figure 6A:
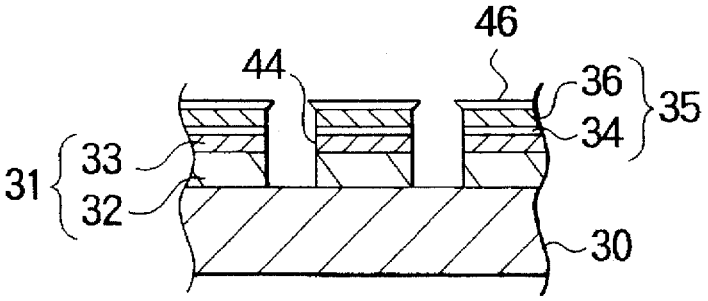
FIGS. 6A to 6C are schematic views of the subsequent steps.
Figure 6B:
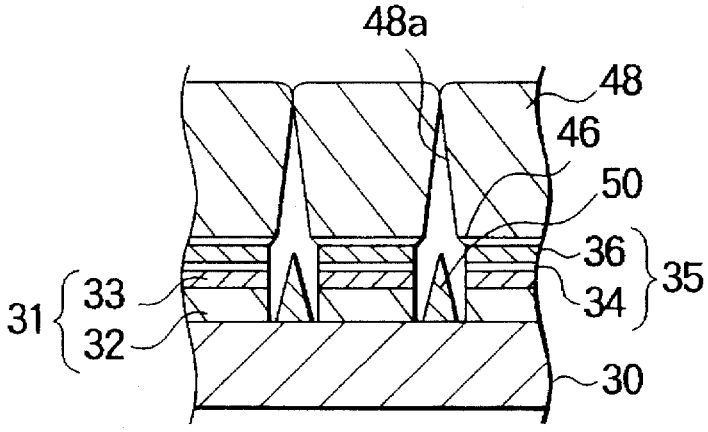
Figure 6C:
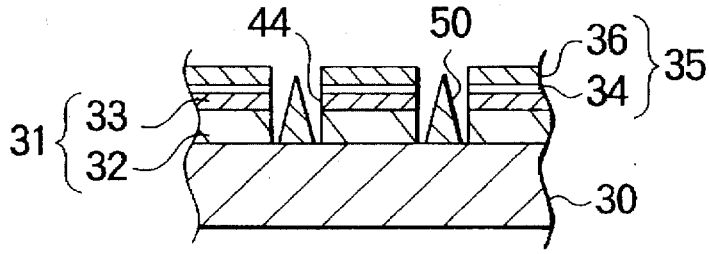

FIGS. 6A to 6C are schematic views of subsequent steps.

Next, as shown in FIG. 6A, a peeling layer 46 is formed on the tungsten silicide film 36 by using the electron beam evaporation system etc. The peeling layer 46 is constituted by for example an aluminum metal layer. The thickness of the peeling layer 46 is not particularly restricted, but is for example about 50 nm. The substrate angle at the electron beam evaporation is preferably about 20 degrees (oblique incidence evaporation). The atmospheric pressure is for example 1.0 Pa.

Next, as shown in FIG. 6B, a cathode-forming layer 48 is stacked on the peeling layer 46 by using for example the electron beam evaporation method. As the cathode-forming layer 48, preferably molybdenum (Mo) is used, but it is also possible to use another high melting point metal or other metal, compound, etc. The angle of the substrate at the electron beam evaporation is preferably about 90 degrees. By forming the cathode-forming layer 48 to a thickness of about 1.0 μm on the surface of the substrate 30 positioned in the bottom portions of the cathode holes 44, cathodes 50 having a sharp conical shape are formed with a uniform shape and height. The shapes of the cathodes 50, particularly the heights, depend on the time until the openings 48*a* of the cathode-forming layer 48 are closed etc. In the present embodiment, there is no taper and shoulder drop in the side walls of the openings of the tungsten silicide film 36, therefore also the step coverage of the cathode-forming layer 48 becomes constant, the time until the openings 48*a* thereof are closed is constant, and the shapes, particularly the heights, of the cathodes 50 can be made uniform.

Next, as shown in FIG. 6C, wet etching (about 30 seconds) is carried out by fluoric acid having a proportion of water to fluoric acid of about 5 to 1 so as to remove the peeling layer 46 composed of aluminum etc. by etching and lift off the cathode-forming layer 48 positioned on this. In the cathode holes 44, microcathodes 20 having a uniform shape and height remain.

Thereafter, on the substrate 30, a transparent substrate on which the phosphor film is formed, a transparent substrate on which a transparent conductive film is formed, etc. are adhered in a vacuum to form the FED.

Second embodiment

Next, an explanation will be made of a second embodiment of the present invention.

The basic configuration of the flat display device having microcathodes according to the present embodiment is similar to that of the first embodiment described before, but the driving methods thereof differ. Below, a detailed explanation will be made of the portions different from those of the first embodiment. Explanations of common portions will be partially omitted.

Figure 3:
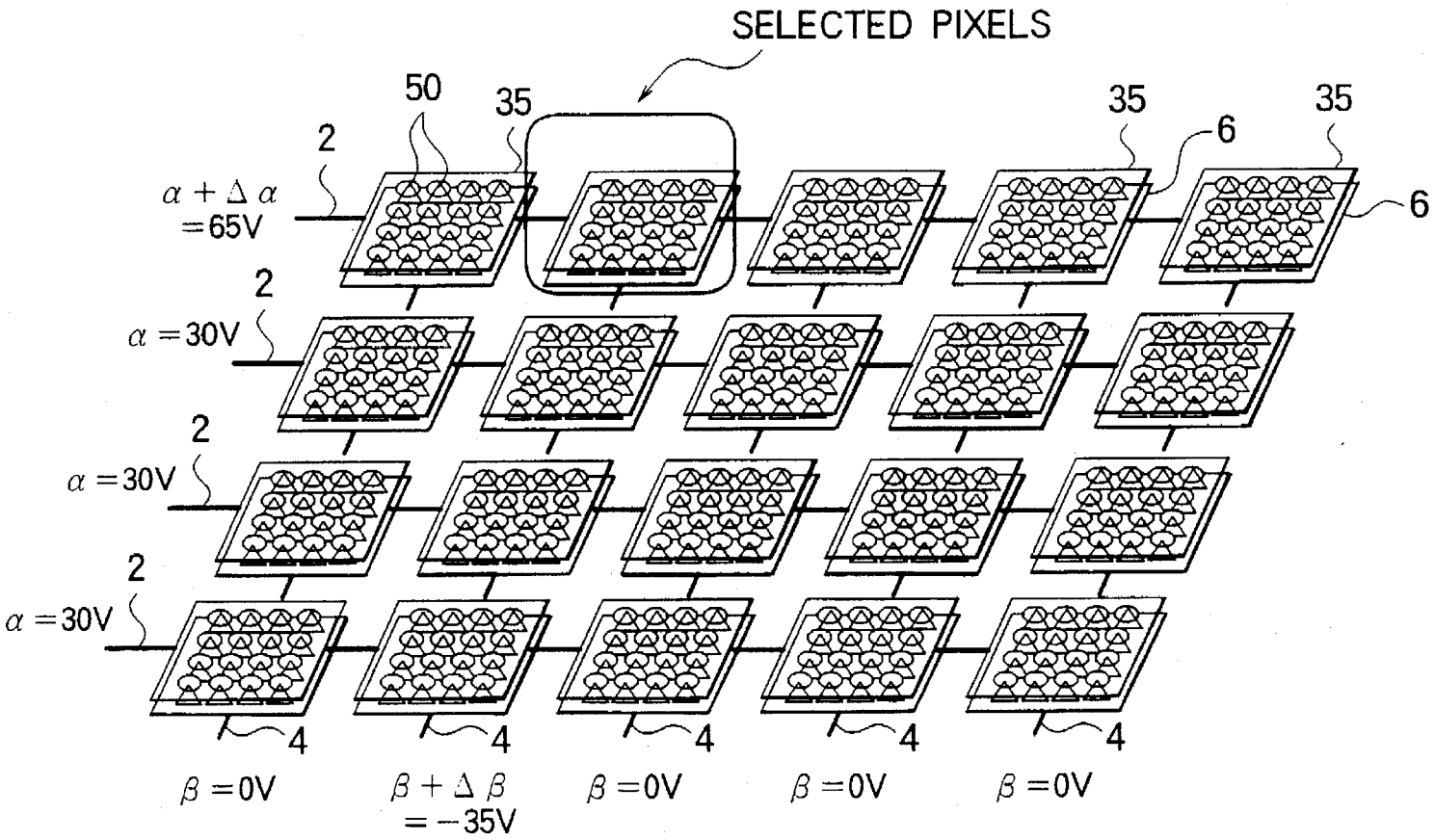
FIG. 3 is a schematic perspective view of a method of driving a flat display device according to another embodiment of the present invention.

FIG. 3 is a schematic perspective view of the method of driving the flat display device according to the second embodiment of the present invention.

As shown in FIG. 3, in the present embodiment, irrespective of the selected pixel and non-selected pixels, the gate electrodes 35 are supplied with a voltage of $\alpha$=30V through the row scanning lines 2. The emitter electrodes 6 are supplied with a voltage of $\beta$=0V through the column scanning lines 4. These voltages are supplied from the row driving circuit and the column driving circuit. Namely, irrespective of the selected pixel and the non-selected pixels, a DC bias voltage is supplied between the emitter electrodes and the gate electrodes.

In the present embodiment, to select a pixel, only the gate electrode 35 to which the microcathodes 50 corresponding to the pixel to be selected belong is supplied with a voltage of $\Delta\alpha$=35V via the row scanning line 2 while being superimposed on the voltage $\alpha$ and, at the same time, only the emitter electrode 6 to which the microcathodes 50 corresponding to the pixel to be selected belong is supplied with a voltage of $\Delta\beta$=−35V via the column scanning line 4 while being superimposed on the voltage $\beta$.

In the present embodiment, the sum of the absolute value of $\alpha$, the absolute value of $\beta$, the absolute value of $\Delta\alpha$, and the absolute value of $\Delta\beta$ is the extraction voltage $V_{ext}$=100V. Also, the sum of the absolute value of $\alpha$, the absolute value of $\beta$, and the absolute value of $\Delta\alpha$ is 65V and $V_{ext}/2$ or more and the sum of the absolute value of $\alpha$, the absolute value of $\beta$, and the absolute value of $\Delta\beta$ is 65V and $V_{ext}/2$ or more.

As a result, in the group of microcathodes 50 corresponding to the selected pixel, a voltage of $\alpha+\Delta\alpha-(\beta+\Delta\beta)$=100V, which is the extraction voltage, is supplied between the gate electrode 35 and the emitter electrode 6. Also, in the non-selected groups of microcathodes 50, either a voltage of $\alpha-\beta$=30V, $\alpha+\Delta\alpha-\beta$=65V, or $\alpha-(\beta+\Delta\beta)$=65V is supplied between the gate electrodes 35 and the emitter electrodes 6.

When the voltage between an emitter electrode and gate electrode is 100V, the emission current from the microcathodes is about 10 μA as shown in FIG. 2, and when the voltage between the emitter electrode and the gate electrode is 65V, as shown in FIG. 2, the emission current is about 1/10 or less of 10 μA. Accordingly, in the present embodiment, the emission current flows in part of the groups of microcathodes 50 of the non-selected pixels. However, that current is 1/10 or less of the emission current of the microcathodes of the selected pixel, so proper luminance and contrast can be obtained in the flat display device.

Figure 4:
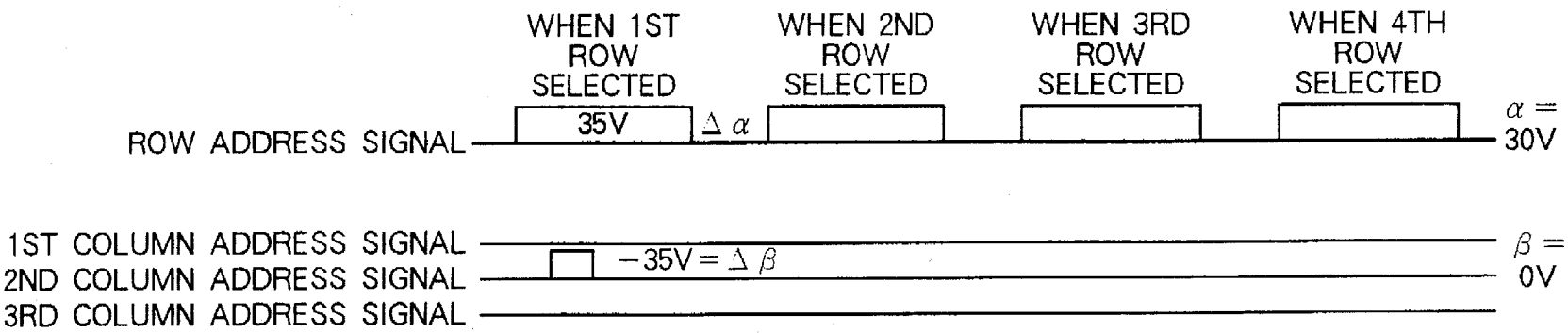
FIG. 4 is a timing chart of a method of driving the flat display device shown in FIG. 3.

FIG. 4 is a timing chart of the method of driving the flat display device shown in FIG. 3.

The voltage $\Delta\alpha$ supplied to the row scanning line 2 to, select a pixel is supplied by the row driving circuit so as to scan the rows while being superimposed on the voltage $\alpha$ as shown in FIG. 4. The voltage $\Delta\beta$ supplied to the column scanning line 4 to select the pixel is supplied by the column driving circuit so as to scan the columns while being superimposed on the voltage $\beta$ as shown in FIG. 4.

The method of production of the microcathodes is similar to that of the first embodiment.

The present embodiment has a similar mode of operation as that of the flat display device according to the first embodiment except that the $\Delta\alpha$ and $\Delta\beta$ become larger in comparison with those of the first embodiment.

Note that, the present invention is not restricted to the above embodiments and can be modified in various ways within the range of the present invention.

For example the above embodiments were configured so that one pixel unit was constituted by a plurality of microcathodes 50 so that even if electrons were not emitted from part of the microcathodes, the pixel as a whole would not become defective, but it is also possible to make each microcathode 50 correspond to a pixel.

As explained above, according to the present invention, the selection of the pixel is carried out by superimposing an extremely fine signal voltage with respect to the DC bias voltage, therefore the amplitude of the ON voltage and OFF voltage can be made small and a reduction of power consumption of the flat display device having microcathodes can be achieved. Also, at the same power consumption as that of a conventional device, it becomes possible to set the driving frequency high.

What is claimed is:

1. A flat display device comprising:

microcathodes arranged in the form of a matrix;

gate electrodes controlled so that electrons are selectively discharged from said microcathodes;

emitter electrodes for supplying a negative voltage to said gate electrodes of one or more selected microcathodes;

a DC voltage supplying means for supplying a DC bias voltage giving an emission current of a predetermined value or less between said emitter electrodes and gate electrodes irrespective of selection and non-selection; and a selective voltage supplying means for supplying a voltage of an extent where electrons are emitted from said microcathodes between said emitter electrode and said gate electrode of the selected microcathodes while being superimposed on the DC bias voltage wherein the DC bias voltage giving the emission current of the predetermined value or less is supplied between said emitter electrodes and said gate electrodes by said DC voltage supplying means irrespective of selection and non-selection so that the emission current of the selected microcathodes becomes 10 times or more of the emission current of the non-selected microcathodes.

2. A flat display device as set forth in claim 1, wherein the DC bias voltage giving the emission current of the predetermined value or less is supplied between said emitter electrodes and said gate electrodes irrespective of selection and non-selection with respect to only the microcathodes existing in a predetermined region of the display device.

3. A flat display device comprising:

microcathodes arranged in the form of a matrix;

gate electrodes controlled so that electrons are selectively discharged from said microcathodes;

emitter electrodes for supplying a negative voltage to said gate electrodes of one or more selected microcathodes;

a DC voltage supplying means for supplying a DC bias voltage giving an emission current of a predetermined value or less between said emitter electrodes and gate electrodes irrespective of selection and non-selection; and a selective voltage supplying means for supplying a selective voltage of an extent where electrons are emitted from said microcathodes between said emitter electrode and said gate electrode of the selected microcathodes while being superimposed on the DC bias voltage wherein, the voltage supplied between said emitter electrodes and said gate electrodes of the selected microcathodes is defined as V, the bias voltage supplied to said gate electrodes of said microcathodes irrespective of selection and non-selection by the DC bias voltage supplying means is defined as $\alpha$ and the bias voltage supplied to said emitter electrodes of said microcathodes is defined as $\beta$, the selective voltage supplied to the selected gate electrodes by said selective voltage supplying means while being superimposed on the bias voltage supplied by said DC bias voltage supplying means is defined as $\Delta\alpha$, and the selective voltage supplied to the selected emitter electrodes is defined as $\Delta\beta$, the sum of the absolute value of $\alpha$, the absolute value of $\beta$, the absolute value of $\Delta\alpha$, and the absolute value of $\Delta\beta$ is V, the sum of the absolute value of $\alpha$, the absolute value of $\beta$, and the absolute value of $\Delta\alpha$ is V/2 or more, and the sum of the absolute value of $\alpha$, the absolute value of $\beta$, and the absolute value of $\Delta\beta$ is V/2 or more.

* * * * *